US006859139B1

(12) United States Patent
Sato

(10) Patent No.: US 6,859,139 B1
(45) Date of Patent: Feb. 22, 2005

(54) CONTROL APPARATUS FOR CONTROLLING MOTOR DRIVE

(75) Inventor: Yoshinobu Sato, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/625,590

(22) Filed: Jul. 24, 2003

(30) Foreign Application Priority Data

Aug. 29, 2002 (JP) ..... 2002-251474
Apr. 22, 2003 (JP) ..... 2003-116643

(51) Int. Cl.[7] ..... E05B 45/06

(52) U.S. Cl. ..... 340/542; 340/543; 340/686.1; 340/686.3; 340/672; 340/825.71

(58) Field of Search ..... 340/542, 543, 340/686.1, 686.3, 672, 825.22, 825.31, 825.69, 825.71; 49/25, 26; 318/468, 286, 445

(56) References Cited

U.S. PATENT DOCUMENTS 6,400,278 B1 * 6/2002 Weyerstall et al. ..... 340/686.3
6,459,223 B2 * 10/2002 Mauel et al. ..... 318/445

* cited by examiner

*Primary Examiner*—Hung Nguyen
(74) *Attorney, Agent, or Firm*—Manabu Kanesaka

(57) ABSTRACT

A control apparatus controls a drive of a motor having a movable part via an electric power converter. The control apparatus includes a detecting device for detecting a position of the movable part of the motor; a locking device for locking the movable part of the motor; and a storage device for storing an initial position at which the movable part of the motor is locked for the first time. It is determined that the movable part is locked at an abnormal position when a deviation between the position detected by the detecting device where the movable part of the motor is locked and the initial position stored in the storage means is larger than a predetermined reference distance.

7 Claims, 9 Drawing Sheets

CONTROL APPARATUS FOR CONTROLLING MOTOR DRIVE

BACKGROUND OF THE INVENTION AND RELATED ART STATEMENT

The present invention relates to a control apparatus for controlling a drive of a motor. More specifically, the present invention relates to a control apparatus for controlling a position of a motor using a position detector.

FIG. 9 is a block diagram showing a conventional door drive controller using a linear motor. The conventional door drive controller includes a door 1; a linear motor 2 having a movable part for driving the door 1; a position detector 3 for detecting a position of the movable part of the linear motor 2; a link 4 for linking the door 1 and the movable part of the linear motor 2; a lock 5 as locking means for mechanically locking the link 4 when the door is closed; and a motor drive controller 6 for driving the linear motor 2 based on a reference position data.

The motor drive controller 6 includes a reference current calculator 7 for calculating a reference current value based on a deviation between a reference position and a detected position detected by the position detector 3, and an electric power converter 8 for supplying a current corresponding to the reference current value calculated by the reference current calculator 7.

When the door 1 is opened and closed, first, the position detector 3 detects a position of the movable part of the linear motor 2 linked to the door 1 via the link 4. The reference current calculator 7 in the motor drive controller 6 calculates a reference current value supplied to the linear motor 2 based on the reference position and the detected position detected by the position detector 3. Then, the electric power converter 8 supplies an electrical current to the linear motor 2 according to the reference current value from the reference current calculator 7. When the door 1 is closed, the lock 5 mechanically locks the link 4 to keep the door 1 closed in a state that the current to the linear motor 2 is stopped. When the link 4 is locked mechanically, the movable part of the linear motor 2 connected to the link 4 is also locked.

When the position detector 3 is failed and outputs no position data, it is possible to determine that the position detector 3 is failed. However, when an incorrect position different from an actual position is outputted, it is not possible to detect the failure of the position detector 3. Further, if a position of the link 4 is shifted from that of the lock 5 due to aging, it is also not possible to detect the shift. Therefore, the actual position is not clearly detected, and it is difficult to correctly lock the link 4 to the lock 5, thereby making the door drive system imperfect and lowering the system reliability.

Further, in the case that the lock 5 does not mechanically lock the link, in order to keep the door 1 closed, it is necessary to continuously supply a current to the linear motor 2. As a result, it is necessary to increase the current capacity of the linear motor 2 and electric power converter 8, thereby increasing a manufacturing cost and a size of the door drive controller.

In view of the problems described above, an object of the invention is to improve the reliability of the door drive controller without increasing the current capacity of the electric power converter.

Further objects and advantages of the invention will be apparent from the following description of the invention.

SUMMARY OF THE INVENTION

According to the present invention, a control apparatus controls a drive of a motor having a movable part via an electric power converter. The control apparatus includes detecting means for detecting a position of the movable part of the motor; locking means for locking the movable part of the motor; and storage means for storing data of a position at which the movable part of the motor is locked for the first time. It is determined that the movable part is locked at an abnormal position when a deviation between the position detected by the detecting means where the movable part of the motor is locked and the position stored in the storage means is larger than a predetermined reference distance.

In the invention, it is possible to output an alarm signal when the deviation between the position detected by the detecting means where the movable part of the motor is locked and the position stored in the storage means is larger than the predetermined proportion of the reference distance.

In the invention, the storage means may store the data of the position at which the movable part is locked at every predetermined time. The control apparatus may further include position estimating means for estimating a position of the movable part at a predetermined time from a time change in the stored position. Accordingly, it is possible to output an alarm signal when the deviation between the estimated position and the position stored in the storage means is larger than a predetermined proportion of the reference distance.

Further, in the invention, the storage means stores the data of the position at which the movable part is locked at every predetermined time. The control apparatus may further include time estimating means for estimating a position of the movable part from a change in the position stored in the storage means with time and an estimated time at which the deviation between the estimated position and the initial position stored becomes larger than a predetermined reference distance. Accordingly, it is possible to output an alarm signal when the estimated time is shorter than a predetermined reference time.

DETAILED DESCRIPTION OF PREFERRED EMBODIMENTS

Figure 9:
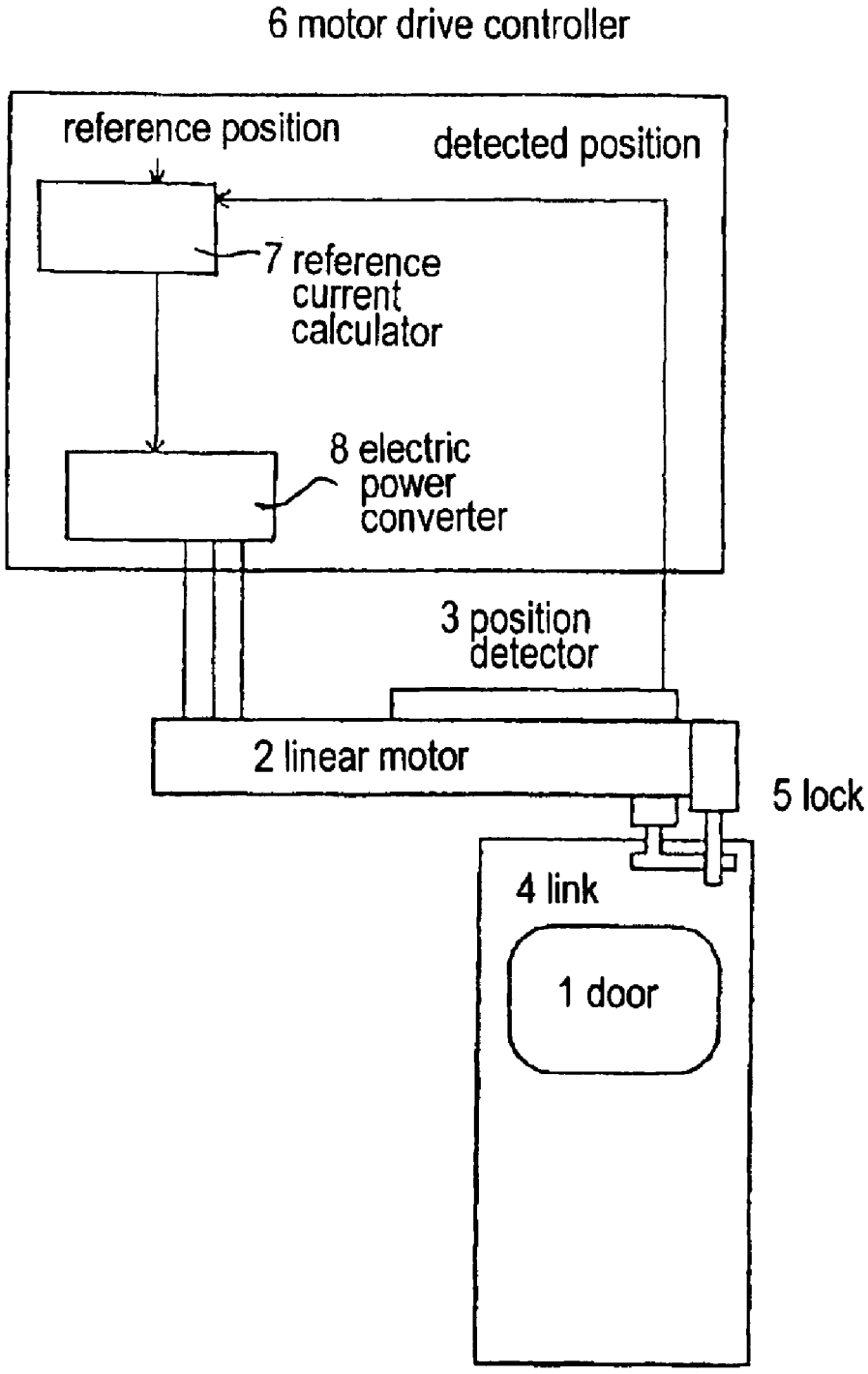
Fig. 9 Prior Art
FIG. 9 is a block diagram of a conventional door drive controller using a linear motor.

Hereunder, embodiments of the invention will be described in detail with reference to the accompanying drawings. In the following drawings, reference numerals same as those used in FIG. 9 designate the same components and their descriptions are omitted for the sake of simplicity.

Figure 1:
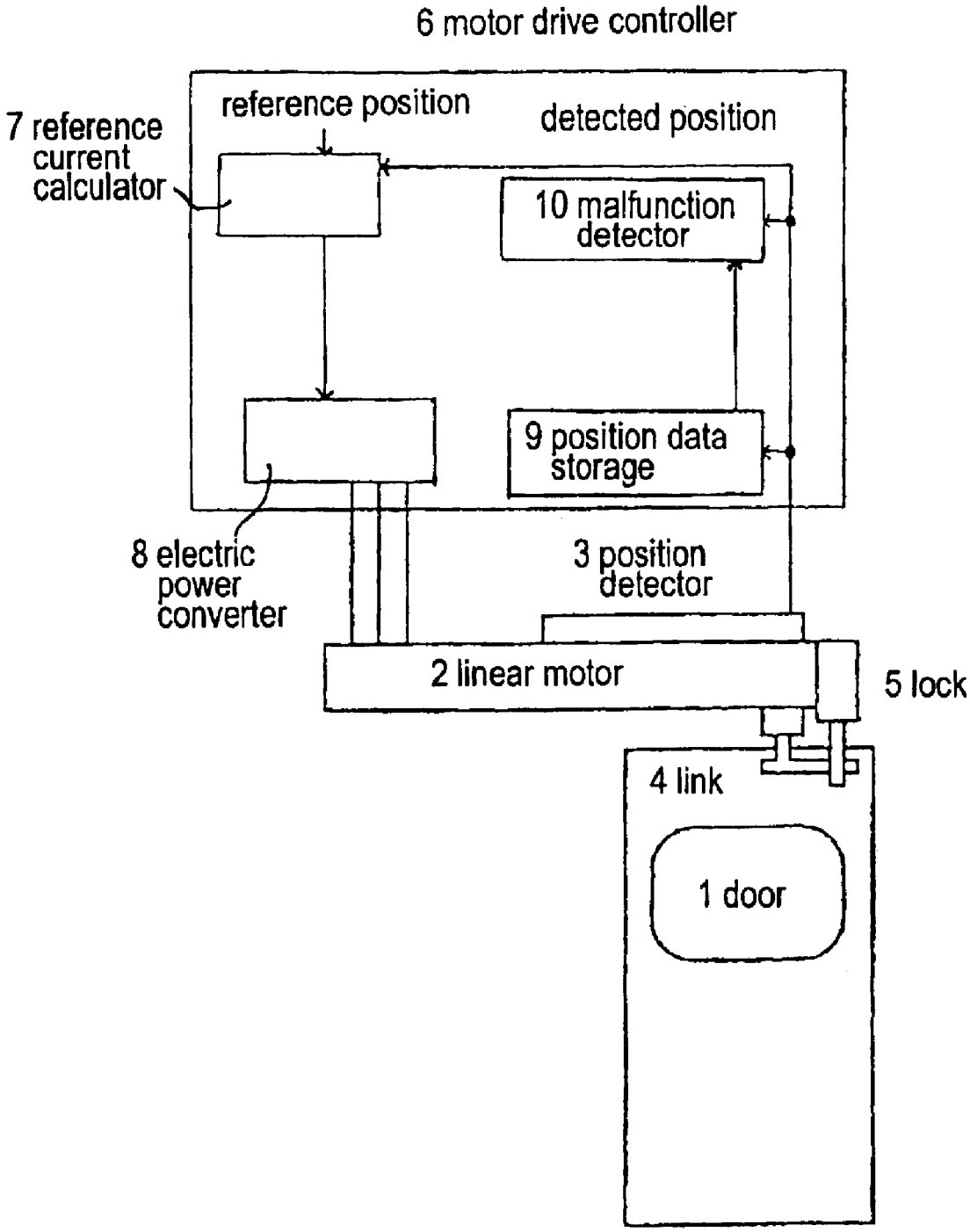
FIG. 1 is a block diagram of a door drive controller according to the invention.

FIG. 1 is a block diagram of a door drive controller according to the first embodiment of the invention. According to the invention, in addition to a conventional door drive controller shown in FIG. 9, a motor drive controller 6 is provided with a position data storage unit 9 for storing a detected position at which a movable part of a motor 2 is locked, and a malfunction detector 10 for determining that the detected position is abnormal when a deviation between a present position detected by a position detector 3 and the position stored in the position data storage unit 9 is larger than a predetermined reference distance.

An operation of the door drive controller according to the first embodiment of the invention will be described next. When a door 1 is closed, a lock 5 mechanically locks a link 4, and the motor drive controller 6 stops supplying electric power to a linear motor 2. When the link 4 is locked mechanically, the movable part of the linear motor 2 connected to the link 4 is also locked. A position at which the movable part of the linear motor 2 is locked is detected and stored in the position data storage unit 9. If the position is deviated from a position stored in the position data storage unit 9 for the first time, the malfunction detector 10 determines that the movable part is locked at an abnormal position.

Figure 2:
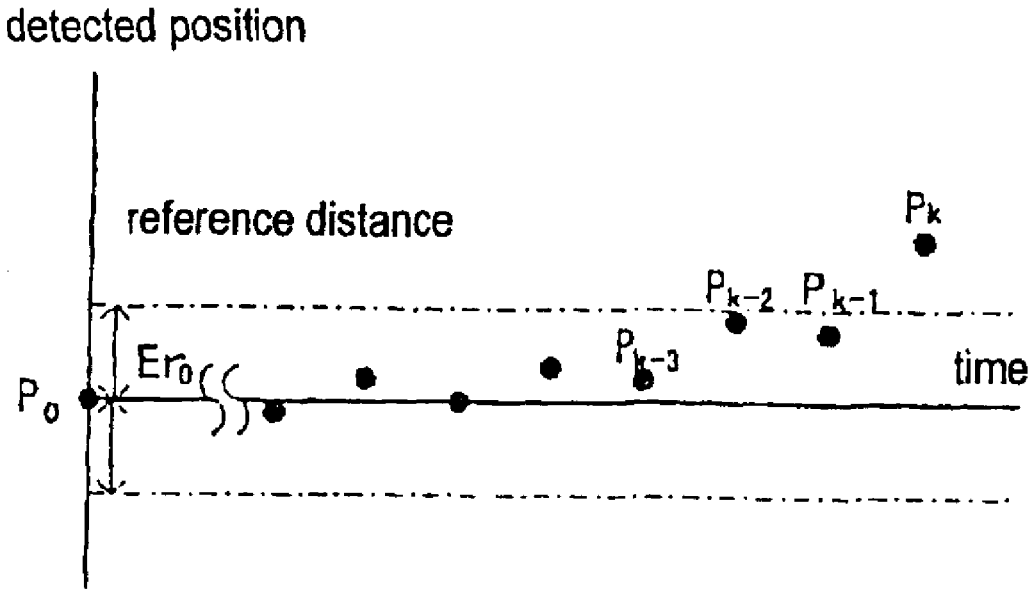
FIG. 2 is a time chart for explaining a process of storing position data.
Figure 3:
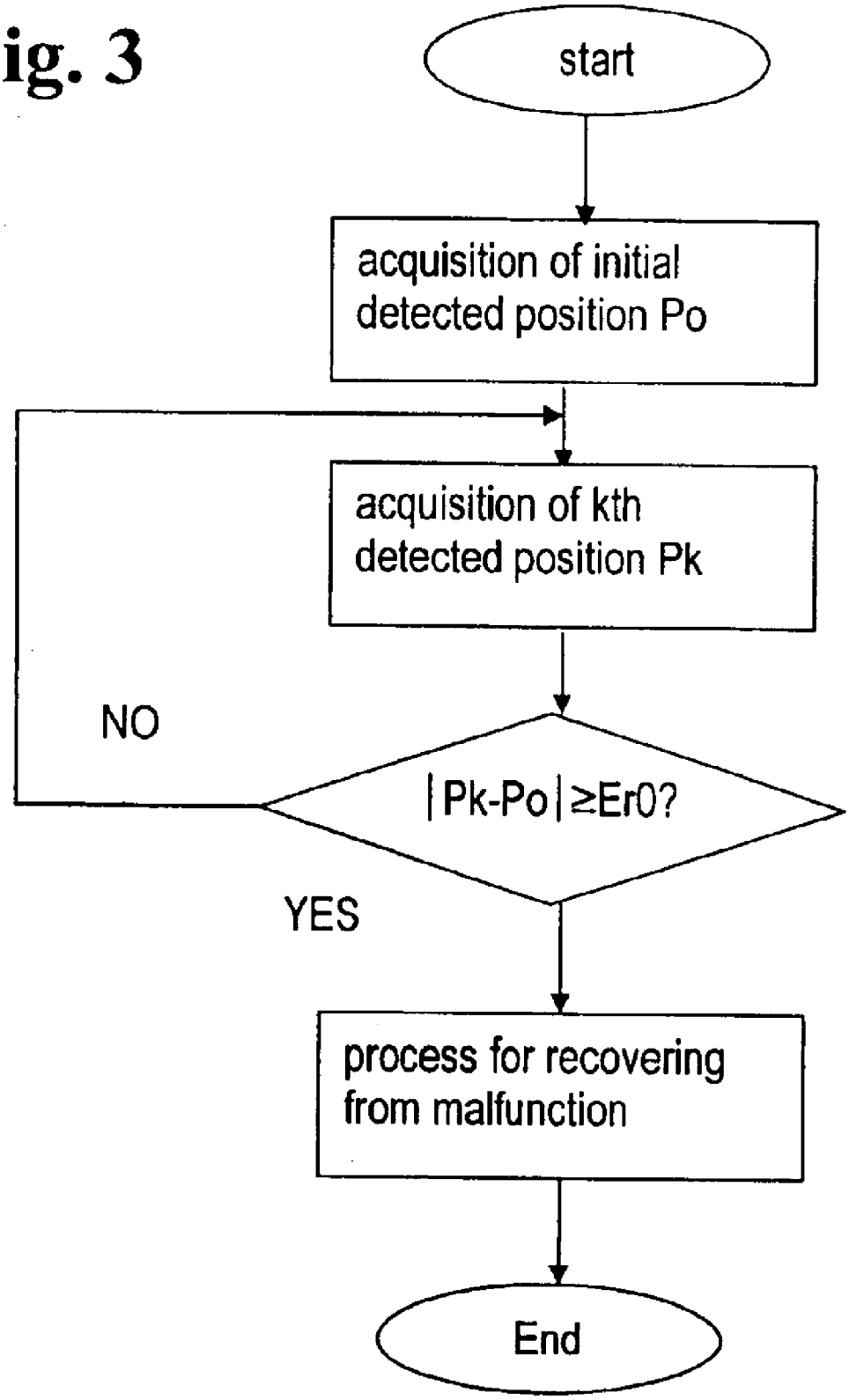
FIG. 3 is a flow chart showing a process of the door drive controller shown in FIG. 1.

FIG. 2 is an example of the position stored in the position data storage unit 9. FIG. 3 is a flow chart showing algorithm for processing the stored position.

In FIG. 2 and FIG. 3, the position at which the movable part of the linear motor 2 is locked for the first time is designated as Po, and the position at which the movable part of the linear motor 2 is locked for the kth time is designated as $P_k$. The predetermined reference distance for detecting the abnormal position is designated as $E_{ro}$. When the deviation between the initial position Po and the kth position $P_k$, that is the present position, is larger than the reference distance $E_{ro}$, it is determined that the movable part is locked at an abnormal position, and a process for recovering from the abnormal position is performed.

Figure 4:
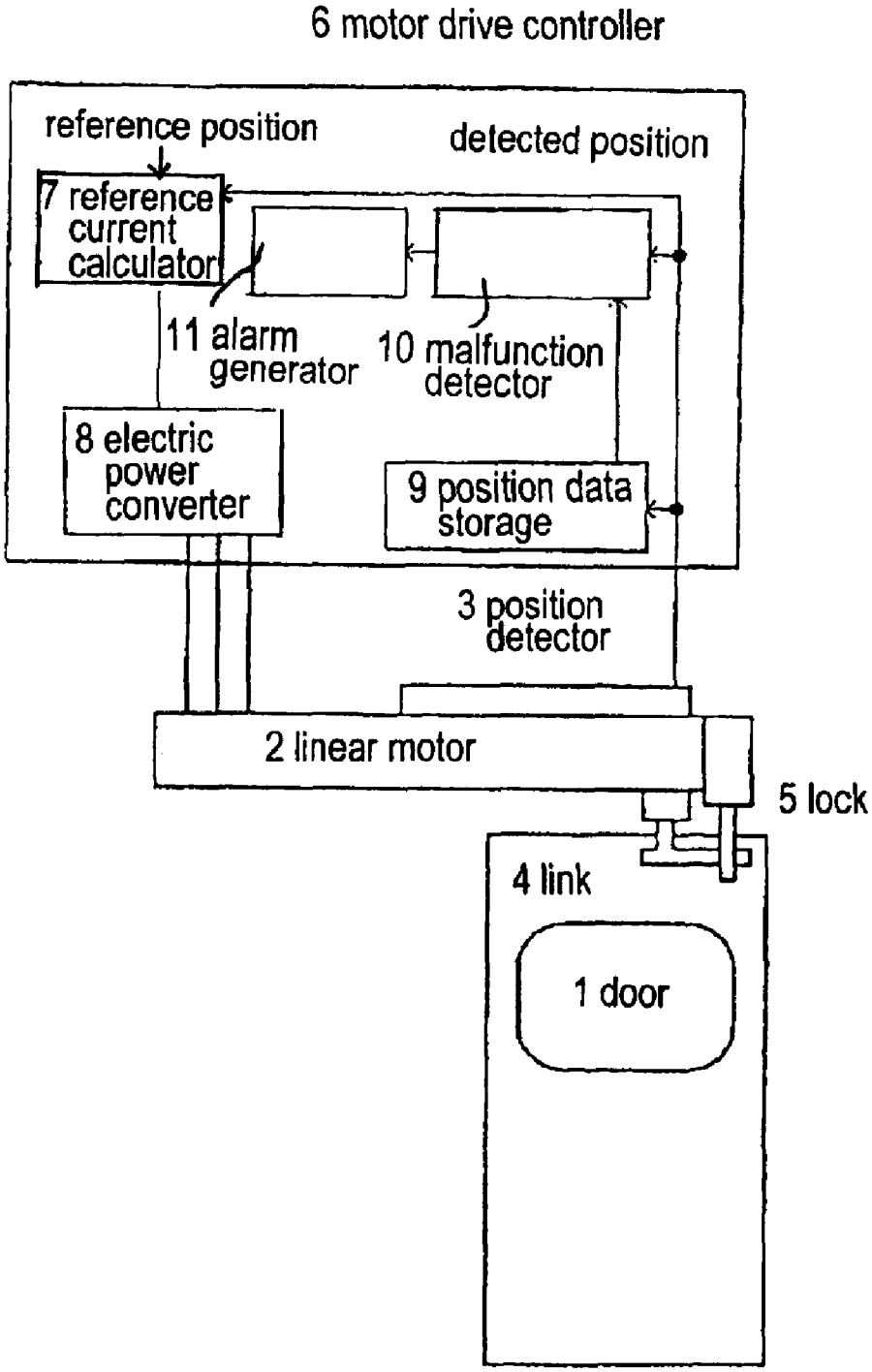
FIG. 4 is a block diagram of a door drive controller according to the invention.

FIG. 4 is a block diagram of a door drive controller according to the second embodiment of the invention. According to the second embodiment, in addition to the door drive controller according to the first embodiment, a door drive controller includes an alarm generator 11 for outputting an alarm signal in response to an output from the malfunction detector 10.

Figure 5:
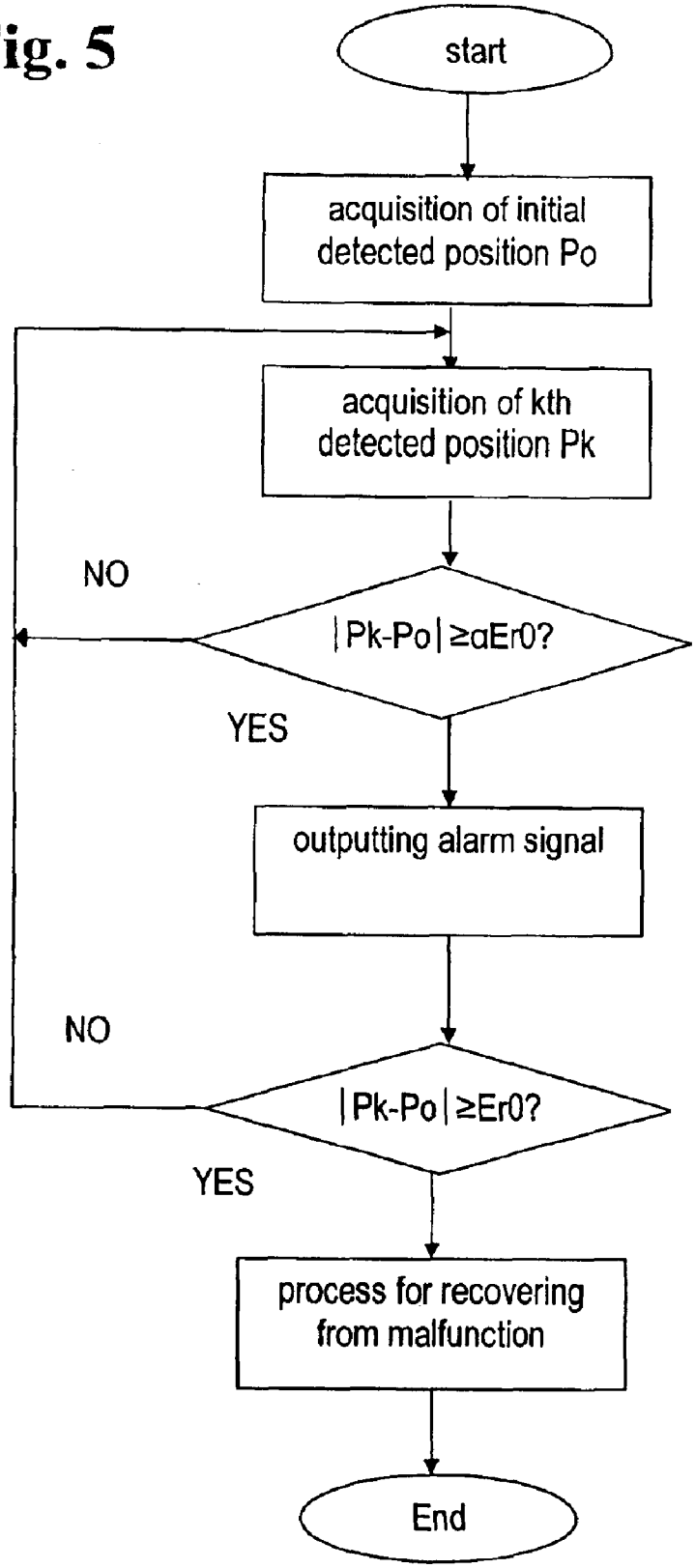
FIG. 5 is a flow chart showing a process of the door drive controller shown in FIG. 4.

An operation of the door drive controller according to the second embodiment will be described next with reference to a flow chart shown in FIG. 5. When the deviation between the initial position Po and the kth position $P_k$ is larger than a certain proportion $\alpha(0<\alpha<1)$ of the reference distance $E_{ro}$, an alarm signal for requesting inspection and maintenance is outputted externally. When the deviation is larger than the reference distance $E_{ro}$, it is determined that the movable part is locked at an abnormal position, and a process for recovering from the abnormal position is performed.

Figure 6:
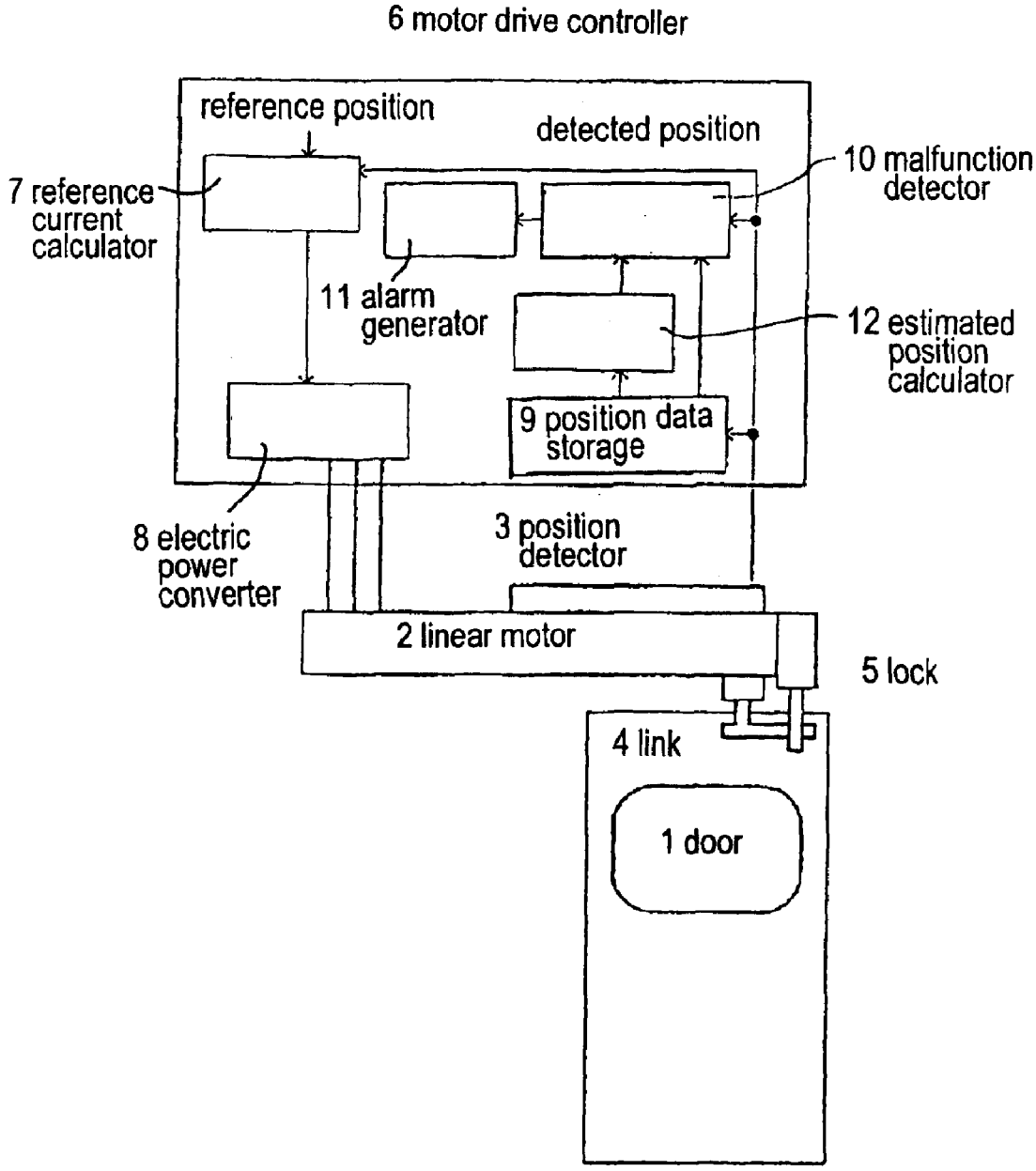
FIG. 6 is a block diagram of a door drive controller according to the invention.

FIG. 6 is a block diagram of a door drive controller according to the third embodiment of the invention. According to the third embodiment, in addition to the door drive controller according to the first embodiment, a door drive controller includes an alarm generator 11 for outputting an alarm signal in response to an output from the malfunction detector 10, and an estimated position calculator 12 for estimating a position at a certain time based on the position stored in the position data storage unit 9.

Figure 7:
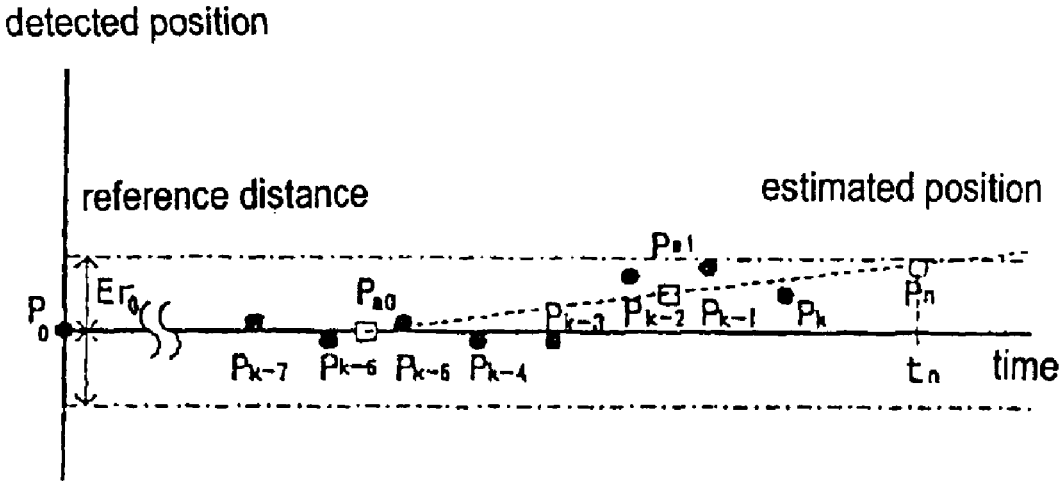
FIG. 7 is a time chart showing a process of the door drive controller shown in FIG. 6.

An operation of the door drive controller according to the third embodiment will be described next. A position at which the movable part of the motor 2 is locked is stored in the position data storage unit 9 at every time To as shown in FIG. 7. The estimated position calculator 12 calculates mean positions $P_{ao}$ and $P_{a1}$ of last four positions, and times $T_{ao}$ and $T_{a1}$ of the mean positions from the following equations.

$$P_{ao}=(P_{k-4}+P_{k-5}+P_{k-6}+P_{k-7})/4 \quad (1)$$

$$P_{a1}=(P_k+P_{k-1}+P_{k-2}+P_{k-3})/4 \quad (2)$$

$$T_{ao}=(T_{k-4}+T_{k-5}+T_{k-6}+T_{k-7})/4 \quad (3)$$

$$T_{a1}=(T_k+T_{k-1}+T_{k-2}+T_{k-3})/4 \quad (4)$$

The position $P_n$ and the deviation $P_{En}$ at a time $T_n$ are obtained from the following equations.

$$P_n=[(P_{a1}-P_{ao})/(T_{a1}+T_{ao})]\times(T_n-T_{a1})+P_{a1} \quad (5)$$

$$P_{En}=P_n-P_o \quad (6)$$

When the deviation $P_{En}$ is larger than a certain proportion a $(0<\alpha<1)$ of the reference distance $E_{ro}$, an alarm signal for requesting inspection and maintenance is outputted externally.

Figure 8:
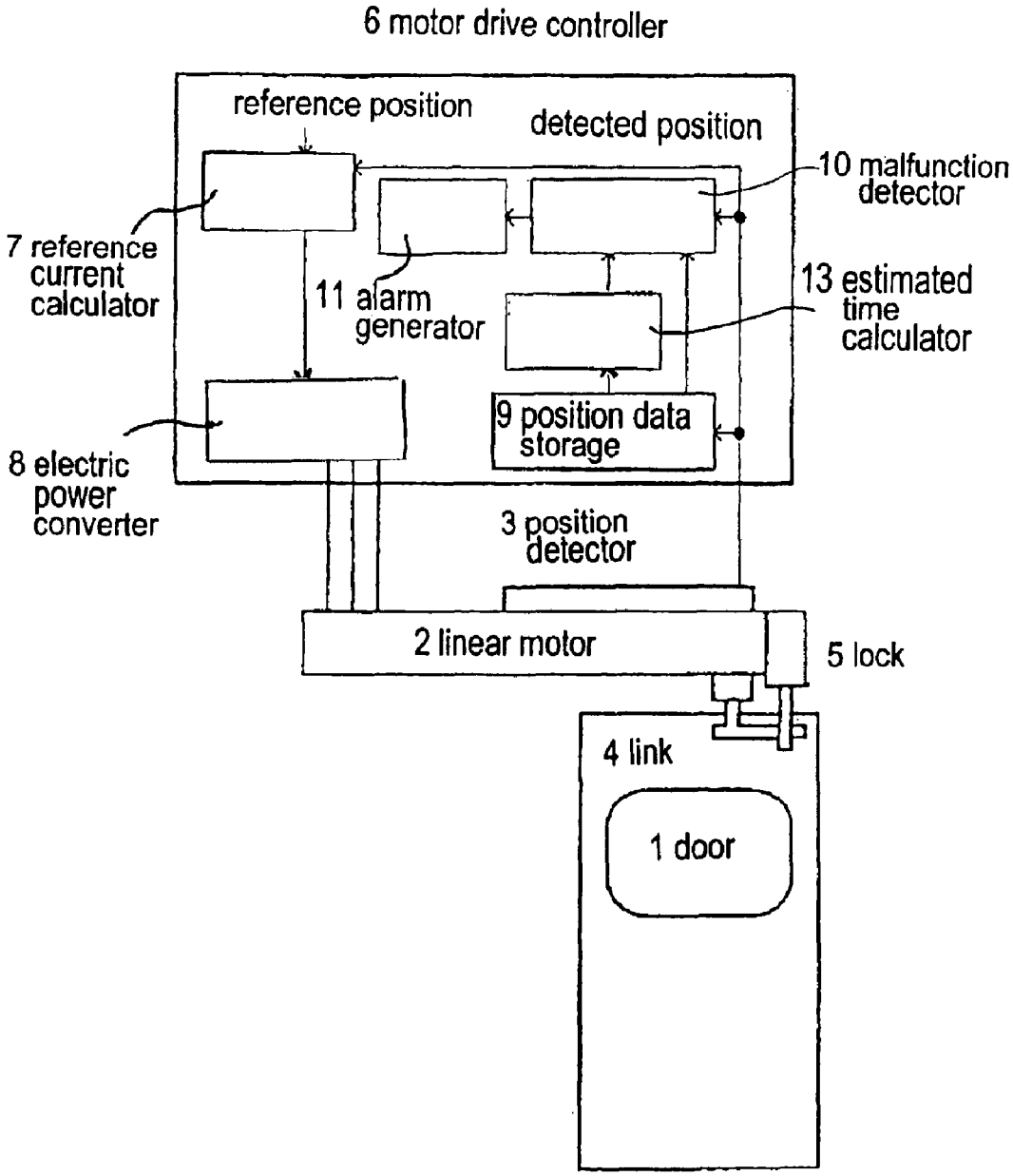
FIG. 8 is a block diagram of a door drive controller according to the invention.

FIG. 8 is a block diagram of a door drive controller according to the fourth embodiment of the invention. According to the fourth embodiment, in addition to the door drive controller according to the first embodiment, a door drive controller includes an alarm generator 11 for outputting an alarm signal in response to the output from the malfunction detector 10, and an estimated time calculator 13 for estimating time at which a deviation is expected to be larger than the reference distance $E_{ro}$ for detecting the abnormal position according to the position stored in the position data storage unit 9.

When a position and time at which the deviation becomes $E_{ro}$ are designated as $P_n'$ and $T_n'$ the time $T_n'$ is derived from the inverse function of the equation (5) and expressed by the following equation (7).

$$T_n'=[(T_{a1}-T_{ao})/(P_{a1}-P_{ao})]\times(P_n'-P_{a1})+T_{a1} \quad (7)$$

When the estimated time $T_n'$ is smaller than a predetermined reference time, an alarm signal for requesting inspection and maintenance is outputted.

In the embodiments described above, the position stored for the first time is used to determine the malfunction. Alternatively, any stored data may be used as a reference.

According to the first embodiment of the invention, it is possible to safely stop the movable part of the door, thereby preventing damage. According to the second through fourth embodiments, in addition to the first aspect, the door drive controller provided with a function of outputting the alarm signal for requesting inspection and maintenance. Therefore, it is possible to prevent an operation time loss due to the stop of the operating instrument caused by the malfunction. It is also possible to clearly find a location of the door drive mechanism to be inspected, thereby improving efficiency of the inspection and maintenance.

While the invention has been explained with reference to the specific embodiments of the invention, the explanation is illustrative and the invention is limited only by the appended claims.

What is claimed is:

1. A control apparatus for controlling a motor with a movable part, comprising:

locking means disposed adjacent to the motor for locking the movable part of the motor, detecting means for detecting a position of the movable part when the movable part is locked, storage means for storing a locking position of the movable part to be locked, and malfunction detecting means electrically connected to the detecting means and the storage means, said malfunction detecting means determining that the locking means locks the movable part at an abnormal position when a deviation between the position of the movable part detected by the detecting means and the locking position in the storage means is larger than a reference value.

2. A control apparatus according to claim 1, further comprising an alarm for sending an alarm signal when the deviation between the position of the movable part detected by the detecting means and the locking position is larger than a predetermined proportion of the reference value.

3. A control apparatus according to claim 1, further comprising position estimating means electrically connected to the detecting means and the storage means for estimating an estimated position of the movable part of the motor.

4. A control apparatus according to claim 3, wherein said storage means stores positions of the movable part when the locking means locks the movable part at every predetermined time as the locking position so that the estimating means estimates the estimated position of the movable part based on a time change in the locking position of the movable part stored in the storage means.

5. A control apparatus according to claim 4, further comprising an alarm for sending an alarm signal when a deviation between the estimated position and the locking position stored in the storage means is larger than a predetermined proportion of the reference value.

6. A control apparatus according to claim 1, further comprising time estimating means electrically connected to the detecting means and the storage means, said storage means storing positions of the locking means for every predetermined time as the locking position, said estimating means estimating an estimated time when a deviation between the estimated position and the locking position stored in the storage means is larger than the reference value.

7. A control apparatus according to claim 6, further comprising an alarm for sending an alarm signal when the estimated time by the time estimating means is greater than a predetermined value.

* * * * *

UNITED STATES PATENT AND TRADEMARK OFFICE

CERTIFICATE OF CORRECTION

PATENT NO. : 6,859,139 B1
DATED : February 22, 2005
INVENTOR(S) : Yoshinobu Sato It is certified that error appears in the above-identified patent and that said Letters Patent is hereby corrected as shown below:

Column 4,
Line 21, change "a" to -- α --

Signed and Sealed this

Fourteenth Day of June, 2005

JON W. DUDAS
*Director of the United States Patent and Trademark Office*